US007950515B2

(12) United States Patent
Gonzalez Alemany et al.

(10) Patent No.: US 7,950,515 B2
(45) Date of Patent: May 31, 2011

(54) MOVING WALKWAY

(75) Inventors: Miguel Angel Gonzalez Alemany, Oviedo (ES); Juan Domingo Gonzalez Pantiga, Gijon (ES); Manuel Alonso Cuello, Gijon (ES); José Ojeda Arenas, La Fresneda-Siero (ES)

(73) Assignees: Thyssenkrupp Elevator Innovation Center, S.A., Asturias (ES); Thyssenkrupp Elevator (ES/PBB) Ltd., London (GB)

( * ) Notice: Subject to any disclaimer, the term of this patent is extended or adjusted under 35 U.S.C. 154(b) by 201 days.

(21) Appl. No.: 12/246,999

(22) Filed: Oct. 7, 2008

(65) Prior Publication Data

US 2009/0101471 A1 Apr. 23, 2009

(30) Foreign Application Priority Data

Oct. 17, 2007 (ES) ..... 200702729

(51) Int. Cl.
*B66B 23/12* (2006.01)

(52) U.S. Cl. ..... 198/327

(58) Field of Classification Search ..... None
See application file for complete search history.

(56) References Cited

U.S. PATENT DOCUMENTS

| | | | | |
|---|---|---|---|---|
| 3,247,947 | A | 4/1966 | Fox et al. | |
| 4,130,192 | A * | 12/1978 | Kraft | 198/327 |
| 4,244,457 | A | 1/1981 | Ernst | |
| 6,085,891 | A * | 7/2000 | Behle | 198/333 |
| 6,607,064 | B2 | 8/2003 | Inoue | |
| 7,063,202 | B2 | 6/2006 | Ossendorf | |

FOREIGN PATENT DOCUMENTS

| | | |
|---|---|---|
| JP | 8-198561 | 8/1996 |

* cited by examiner

*Primary Examiner* — Gene Crawford
*Assistant Examiner* — Kavel Singh
(74) *Attorney, Agent, or Firm* — Merchant & Gould P.C.

(57) ABSTRACT

The invention relates to a moving walkway formed by a series of pallets (1) with a rectangular contour having a passable surface and connected with drive means. The pallets are consecutively connected to one another along the end sections of their adjacent parallel edges, by means of connection devices defining hinges with a pin perpendicular to the direction of movement of the pallets, and have between said sections means defining, in the forward movement path of the walkway, mutual supports between coplanar consecutive pallets.

13 Claims, 8 Drawing Sheets

MOVING WALKWAY

This application is a claims benefit of Serial No. P 200702729, filed 17 Oct. 2007 in Spain and which application is incorporated herein by reference. To the extent appropriate, a claim of priority is made to the above disclosed application.

OBJECT OF THE INVENTION

The present invention relates to an attachment between pallets for a moving walkway, especially intended to transport people and/or goods comprising a longitudinally moveable floor.

More specifically the walkway of the invention is of the type the floor of which is formed by means of a series of transverse pallets with a rectangular contour having a passable outer surface and attached to one another with a solution without lubrication, determining a continuous band with limited forward and return sections between end change-of-direction heads.

BACKGROUND OF THE INVENTION

In traditional concept walkways each pallet is attached to the traction chain such that the pitch of the pallets must be a whole number of chain pitches.

In addition, the excessive pitch of the pallet forces having very high transition radii in the curves of the inclined walkways, in short making the walkway too long. When the pitch of the pallet is very large, the polygon which it makes does not allow reducing the transition circumference as accurately, therefore in one rotation direction gaps are opened between the pallets, unacceptable by the standard, and in the other rotation direction interferences occur which do not allow the rotation between pallets.

Other types of walkways with pallets have been proposed in order to solve these problems as those described in patents JP08198561A2, U.S. Pat. No. 4,244,457, U.S. Pat. No. 6,607,064, U.S. Pat. No. 7,063,202 and U.S. Pat. No. 3,247,947.

U.S. Pat. No. 4,244,457 and U.S. Pat. No. 6,607,064 propose concepts in which each pallet is hinged in several parts, allowing the transition radii in the paths of the pallets to be smaller and reducing the total size of the walkway. However they continue maintaining the pallet chain which is traditionally used to carry out the transition on the walkway, the primitive diameter of which is what marks the size of the heads. This involves an extra cost and a relatively large size of the heads.

U.S. Pat. No. 7,063,202 proposes a support between pallets in which the pallet is supported, on one hand on its rollers and on the other hand it is supported on the next pallet, distributing the load between the adjacent pallets. An effective attachment between pallets is not carried out because the traction is carried out with a belt. Therefore at the time of supporting a pallet on the next pallet, noises can occur. In the return branch of the pallets, the support between pallets is not carried out due to gravity, therefore the position of the pallets is defined by the support rollers and by the binding to the traction belt, forming a situation which is not very stable, taking into account that the belt is an elastic element.

These three types of walkways as well as the traditional traction concept have the drawback of the high number of components needed, increasing both the cost and time necessary for their assembly.

In the case of patent JP08198561A2 a walkway is proposed in which the pallets allow reducing the height thereof, but said pallets are not attached to one another, such that they can only be moved by thrust and not by traction. This would generate compression problems for the walkway, with the possible opening of gaps in certain areas. On the other hand, the overturning is carried out such that it does not allow the pallets to be hinged to one another. It also makes it necessary to install four rollers in each pallet as well as the guiding and counter-guiding along the entire run of the walkway.

In U.S. Pat. No. 3,247,947 the pallets are attached to one another by means of a hinge needing lubrication in order to prevent excessive wear between both surfaces, causing the appearance of lubricant both in visible areas of the pallet and in the adjacent areas. In addition, this patent proposes grooves ending in a rounded manner with the center in the hinge between pallets in order to prevent the interference between adjacent pallets. This solution causes sharp concave shapes which can be dangerous for the users.

SUMMARY OF THE INVENTION

The object of the present invention is to eliminate the drawbacks set forth by means of a walkway in which the pallets are hinged to one another and furthermore have means determining, in the forward movement section of the walkway, supports between coplanar consecutive pallets.

With the constitution shown, the pallets of the walkway are attached such that they can act as a traditional chain and maintain the continuity of the walkway at all times, needing half as many rollers as in the walkway of JP08198561A2.

According to the present invention, the pallets are consecutively connected to one another along the end sections of their adjacent longitudinal edges, by means of connection means defining between consecutive pallets hinges with a pin perpendicular to the direction of movement of said pallets. The pallets also have, between the end hinge sections, means defining, in the forward movement path of the walkway, mutual supports between coplanar consecutive pallets.

The mentioned connection means between pallets are formed by groups of vertical tabs projecting from end sections of the longitudinal edges of the pallets, below the passable surface, in alternating positions on both edges. With this constitution, the tabs of opposing sections of consecutive pallets are placed against one another. All the tabs have an orifice which is aligned on all the tabs for receiving the hinge pins which are perpendicular to the direction of movement.

Every two consecutive pallets are thus hinged to one another by two aligned pins, each of them assembled between the groups of end tabs placed against one another. The sections occupied by the tabs and therefore the length of the pins will be rather less than half the length of the corresponding edges of the pallets.

With regard to the means defining the supports between consecutive pallets, they consist of a longitudinal projection vertically projecting from the lower surface of each pallet, in a position adjacent to one of its longitudinal edges, and in a horizontal longitudinal platform projecting from the opposite edge, at a height coinciding with the end of the mentioned projection. The projection and the platform run between the end groups of tabs and are vertically opposed and supported between one another on coplanar and consecutive pallets running on the forward movement section of the walkway.

With the mentioned constitution, the traction on the walkway is carried out by means of the pallets, attached to one another by two pins perpendicular to the direction of the movement and placed only at the ends of the pallets. This circumstance facilitates their disassembly due to the shorter length of the pins in the cases in which there is less lateral space of the pallet, which would not allow placing a continuous pin along the entire length of the edge thereof.

The pitch of the pallets is reduced such that they allow reducing the size of the heads of the walkway, which in turn allows them to be overturned in a much smaller space than with the traditional concept.

Despite the fact that the attachment between pallets is only carried out at the ends, the pallets are supported at their central part, in the forward movement section of the walkway, such that each pallet not only supports the vertical loads to which it is going to be submitted, but rather it shares the loads with the adjacent pallets.

A pallet for a moving walkway according to the invention thus allows reducing the size of the moving walkway, both at its heads and at its central part, eliminating the traction chain, distributing the vertical loads of the pallets and in short, optimizing the stresses applied to the structure of the pallet.

With the hinge between pallets formed in the manner shown, the radius of the path of the pallets can be reduced in the transition areas for walkways with curves and in the overturning radius, allowing less space to be needed in the heads and allowing the length of the walkway for one and the same level difference to be less.

As is traditional, a series of grooves are included at the upper part of the pallets, necessary to comply with the laws related to moving walkways and mechanical stairs, which in disembarkation areas are intertwined with the combs marking the transition with the fixed area of the walkway.

In addition, in order to prevent the grooves from lifting while the pallet overturns, the grooves will end as close as possible to the vertical of the hinge pin, the next pallet covering the gap left by the previous pallet. For the purpose of reinforcing the pallets, at the lower part thereof there is included a rib providing the vertical rigidity necessary to support the weight of the users on said pallets, maintaining the minimum distances between the fixed parts and the mobile parts and preventing the opening of large gaps in the transition area between the disembarkation combs and the actual pallet.

The load distribution between pallets is achieved by means of the described support means, leaving a minimum gap in the support in order to prevent interference from occurring when the pallets are hinged by the pin, but allowing that when a pallet is distorted, it is supported on the next pallet. It is thus achieved that the load is distributed between several pallets, preventing designing each of them separately in order to support the maximum load to which they will be subjected.

In addition, the pallets have on the inner surface engagement means for communicating the traction to the band of pallets, as well as the ribs necessary for reinforcing each pallet for supporting the stress due to same.

Due to the fact that the dimension of the pallets is reduced in the direction of movement thereof and due to the fact that the hinge pin between pallets is located near the passable surface thereof, it is possible to design inclined walkways with small transition radii.

Each of the hinge pins between pallets has assembled thereon a roller which is located after the outermost tab, which roller is intended to be supported and roll on fixed lateral guides belonging to the structure of the walkway for example.

Each hinge pin will preferably be fixed to one of the two pallets which it connects by means of an anchoring element, whereas it will be able to freely rotate with respect to the other pallet, a friction bushing or bearing being able to be placed in this case under pressure in the pallet moving with respect to the pin in order to prevent wear, excessive noises and above all the need for lubricants dirtying the visible surface on which the users are placed.

The anchoring element for anchoring the pin to one of the pallets consists of a bolt traversing the pin and one of the tabs of the pallet to which said pin is fixed. The bolt is axially moveable between an inner release position, in which it does not traverse the mentioned pin and tab, releasing the pin from the pallet, and an extracted retention position, in which it traverses the pin and the pallet, locking the rotation and extraction of said pin. The bolt is constantly driven toward the locking position by means of a spring. The bolt can be manually removed, moving it against the force of the spring to extract the pin of the pallets and open the walkway, for example in matters of maintenance or substitution of the pallets. Both the bolt and the spring are housed in an inner cavity of the pin.

This cavity likewise allows housing parts used for laterally guiding the band of pallets fixed by clipping. The pallet will laterally have a ramp in order to facilitate introducing the bolt in its corresponding housing in the pallet.

With this system a simple assembly and disassembly of the pin is achieved which facilitates both the automation of the manufacture and maintenance tasks.

BRIEF DESCRIPTION OF THE DRAWINGS

The attached drawings show an embodiment of a moving walkway, formed according to the invention and with reference to which a more detailed description of the walkway will be given.

In the drawings.

DETAILED DESCRIPTION OF THE PREFERRED EMBODIMENTS

The invention will be described as it is applied to a moving walkway. However it must be understood that the concepts described in this specification can be equally applied to other types of transport systems.

Figure 1:
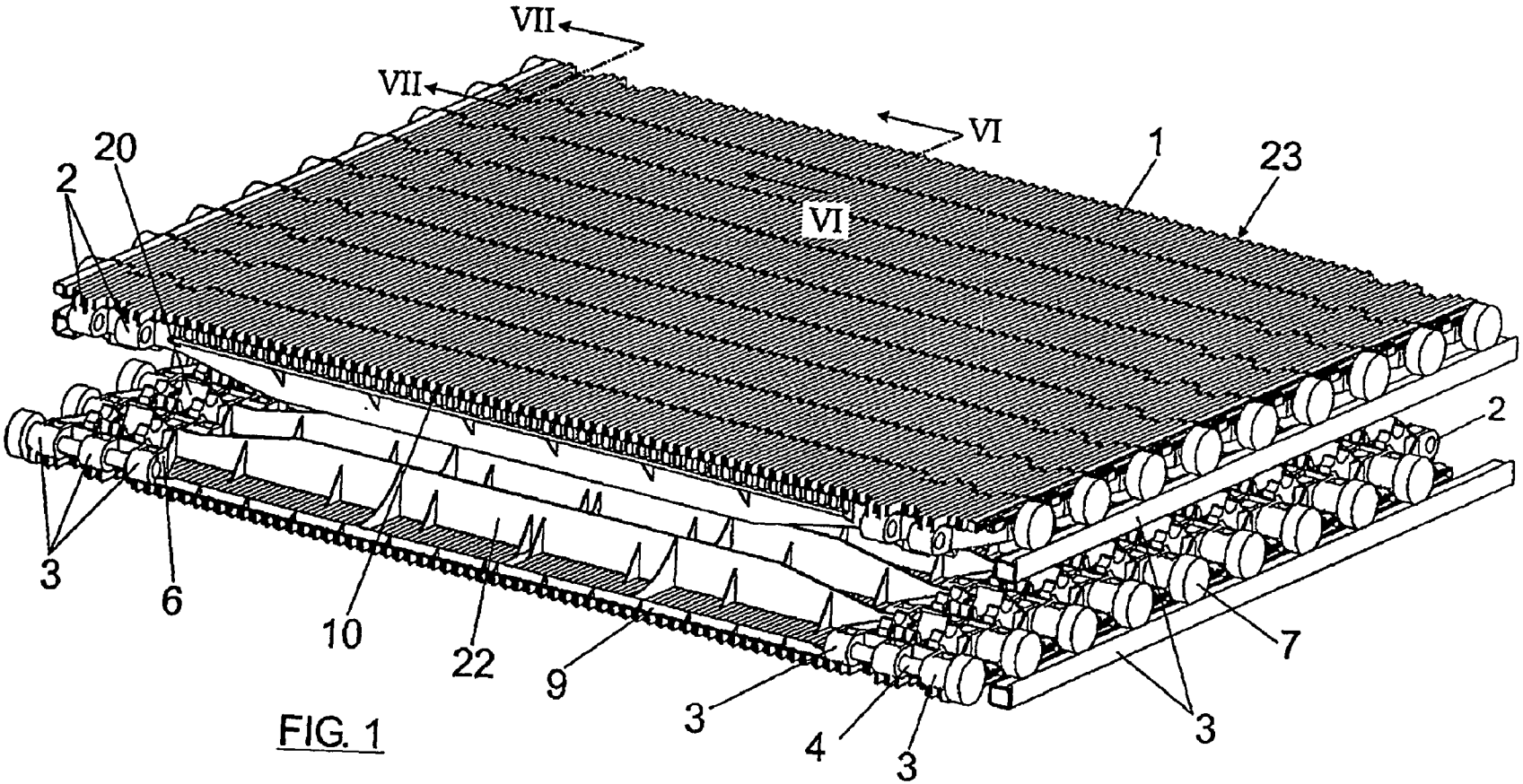
FIG. 1 is a partial perspective view of a moving walkway formed according to the invention, showing coincident parts of the forward and backward movement paths of the walkway.

As can be seen in FIG. 1 the walkway is formed by a series of pallets 1 which, with respect to the pallets of traditional walkways, are small in size in the direction of movement of the walkway. These pallets 1 are connected to one another along the end sections of their adjacent parallel edges by means of connection means which in the example shown in the drawings are formed by groups of vertical tabs 2 and 3 projecting from end sections of the pallets, below the passable surface thereof. The tabs 2 and 3 of opposite groups belonging to the two edges of the pallets are in alternating positions, the group of tabs 2 being able to include only two tabs and the group of tabs 3 being able to include three tabs. Thus, upon consecutively placing the pallets against one another the tabs 2 are introduced between the tabs 3, defining a type of tonguing and grooving.

All the tabs 2 and 3 have orifices which are aligned with one another upon placing the pallets 1 against one another for receiving hinge pins 4, which will be perpendicular to the direction of movement of the band of pallets.

As can be seen, the sections occupied by the tabs 2 and 3 and therefore the length of the pins 4, is much less than half the length of the edges of the pallets in which said tabs are located.

With the described constitution a hinge between pallets is created, forming an endless band used both as a traction chain and as a support for the users of the walkway.

Figure 2:
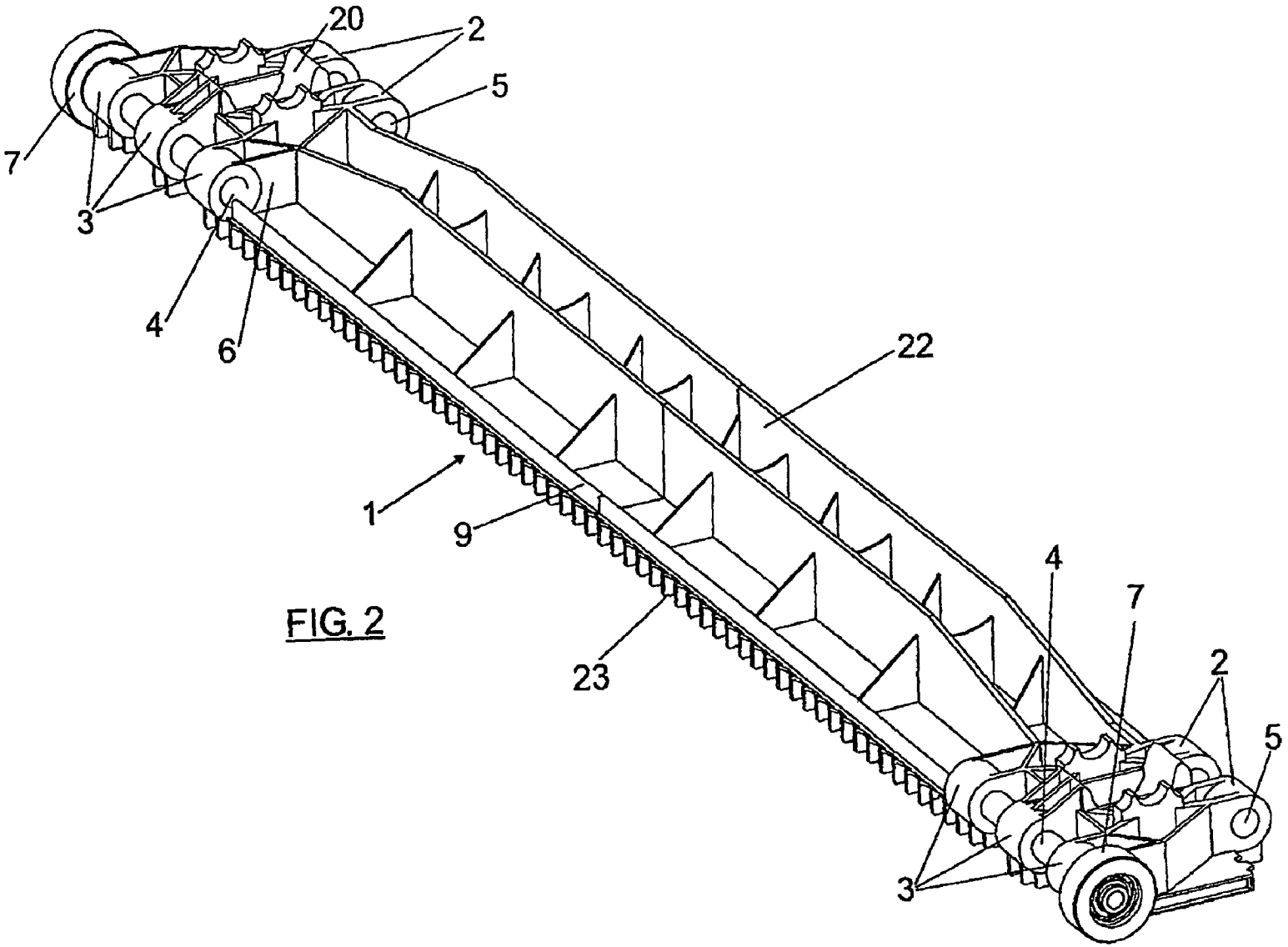
FIG. 2 is a lower perspective view of one of the pallets forming part of the walkway of the invention.

FIG. 2 shows the opposite groups of tabs 2 and 3 belonging to the two parallel edges of the pallets, occupying alternating positions for their mutual coupling in a tongued and grooved manner in consecutive pallets, the orifices 5 of all the tabs being aligned for receiving the pins 4. Traction ribs 6 can run between the tabs 2 and 3 of both sides for reinforcement.

Figure 3:
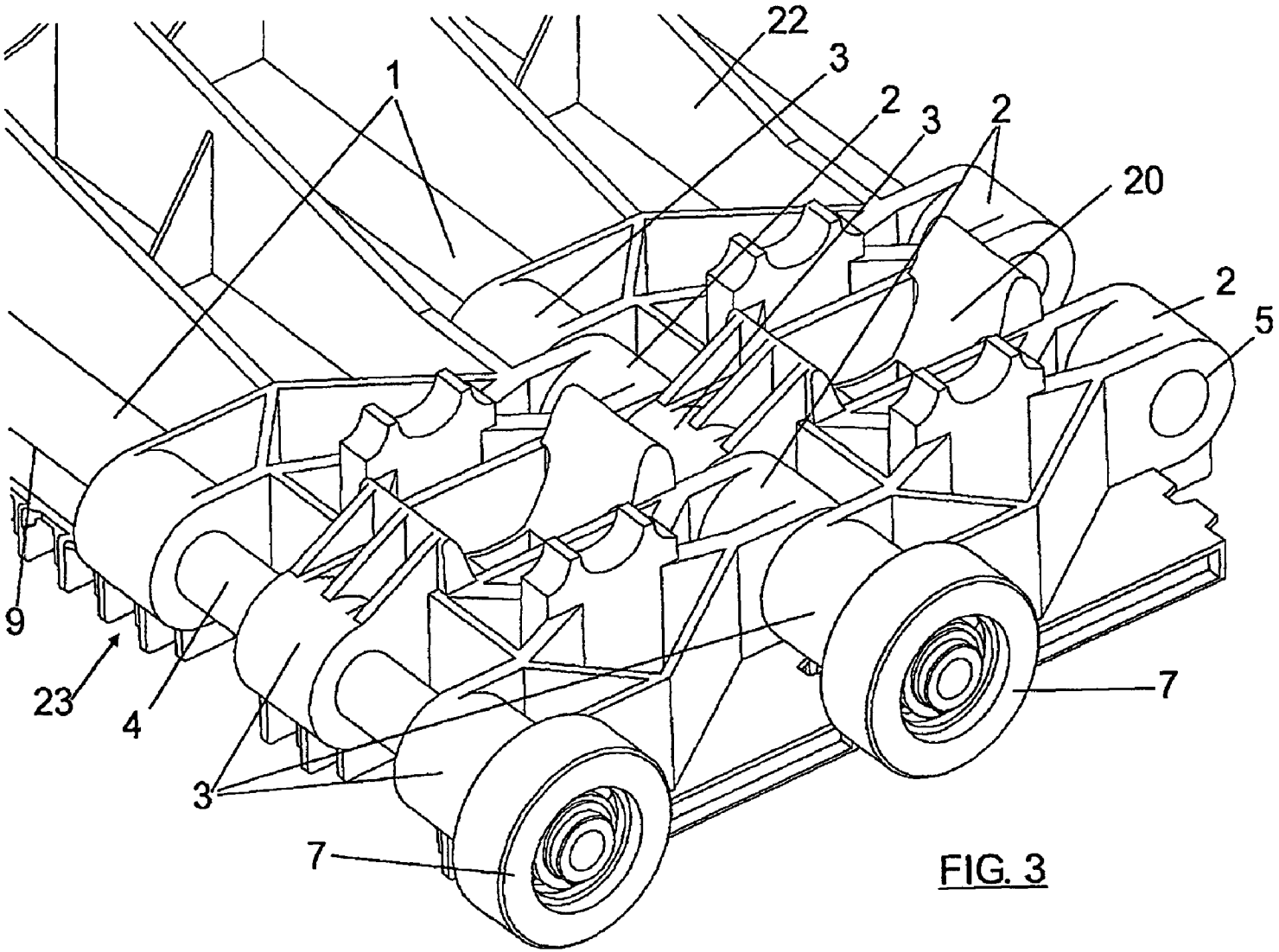
FIG. 3 is a lower partial perspective view of two pallets connected to one another through the end hinge sections.
Figure 5:
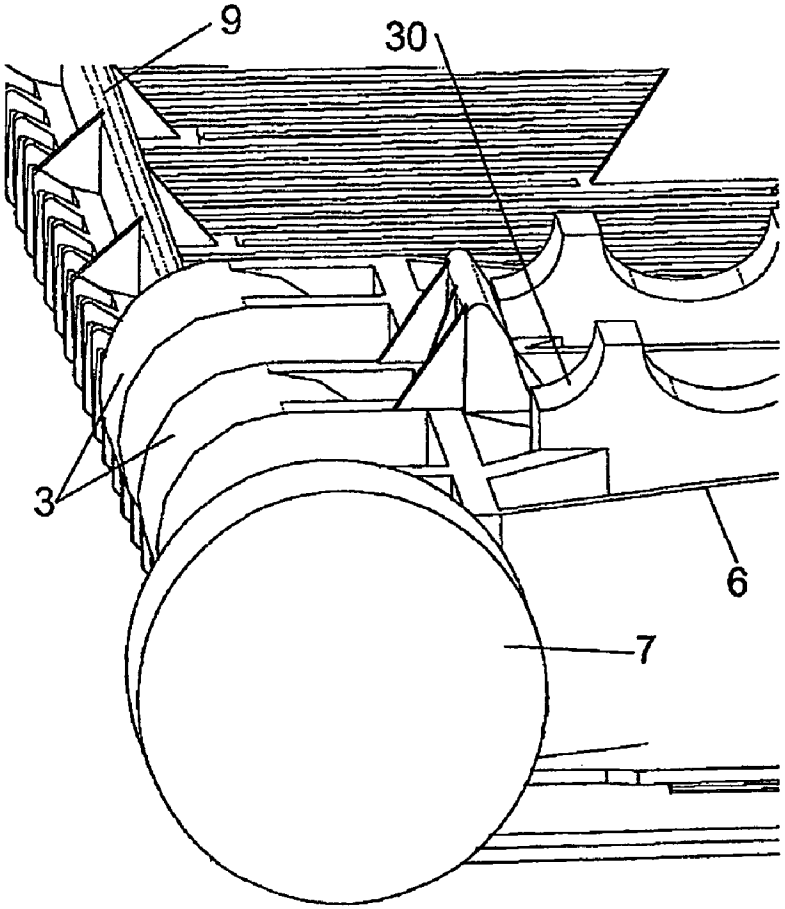
FIGS. 4 and 5 show a lower perspective view of the front and back area respectively, of a pallet, partially showing the support means therebetween.

FIG. 3 shows a lower perspective view of two consecutive pallets 1 hinged to one another, the tabs 2 of one of the pallets being introduced between the tabs 3 of the other pallet, with the corresponding orifices aligned for receiving the hinge pin 4. This pin has assembled thereon an outer roller 7, which is located outside the outermost tab 3 and which is intended to be supported and roll on a fixed guide 8, FIG. 1, assembled on the structure of the walkway for example.

Figure 4:
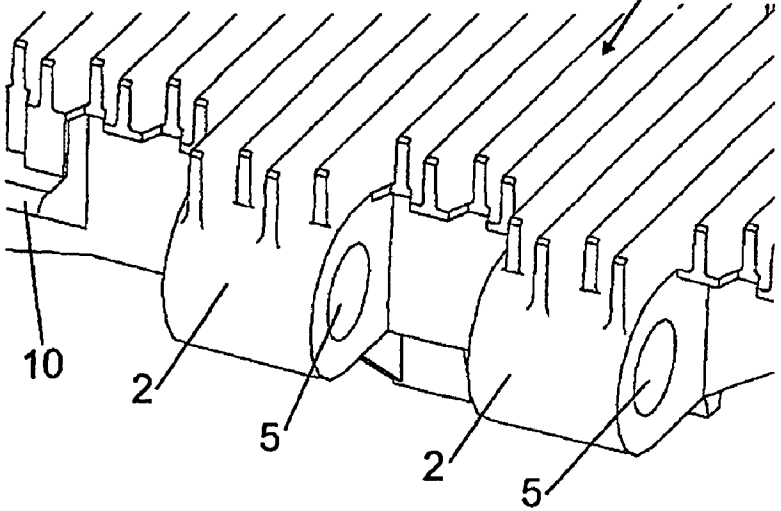

The pallets 1 also has means on the lower or inner surface, which means define, in the forward movement path of the walkway, mutual supports between coplanar consecutive pallets. The support means are formed by a longitudinal projection 9, FIGS. 1 to 3 and FIG. 5, vertically projecting from the lower surface of each pallet, in a position adjacent to one of the longitudinal edges, and in a horizontal longitudinal platform 10, FIG. 4, projecting from the opposite edge, at a height coinciding with the end or edge of the projection 9.

Figure 6:
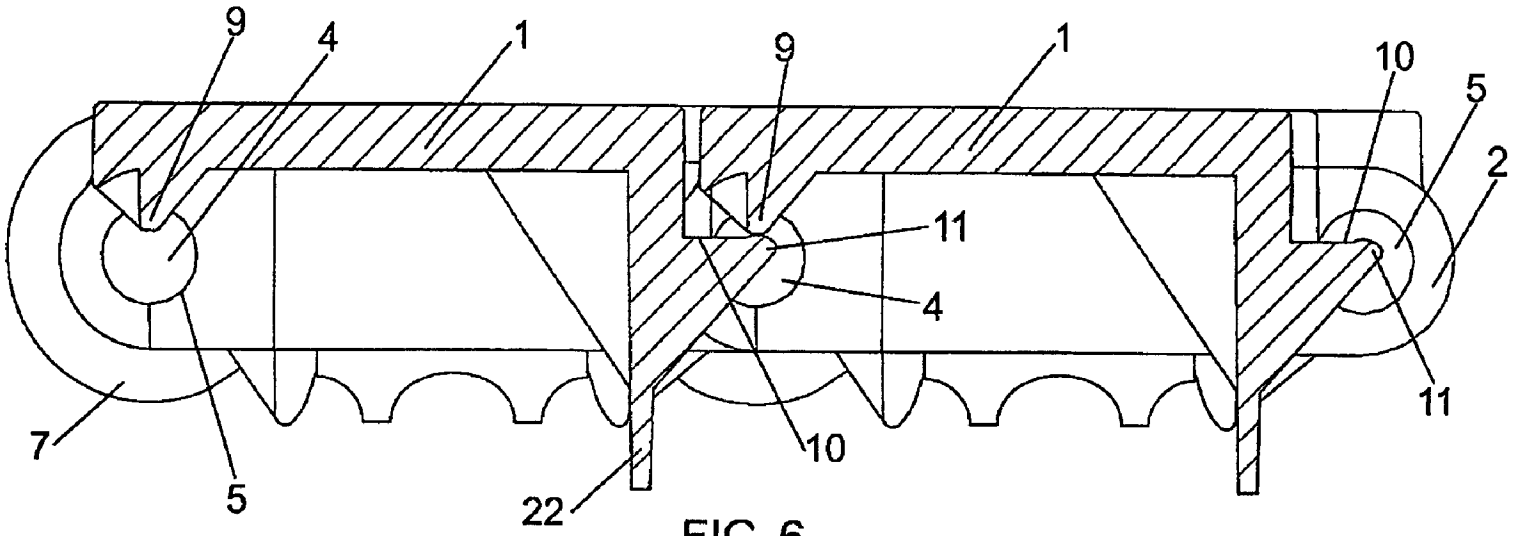
FIG. 6 shows a section of two consecutive pallets, according to the direction of movement, taken according to section line VI-VI of FIG. 1.

FIG. 6 shows how in the forward movement path of the walkway, the projection 9 of one pallet is supported on the platform 10 of the pallet located immediately behind it. Both the projection 9 and the platform 10 extend along the corresponding edges of the pallets, between the end sections occupied by the tabs 2 and 3.

The strength of the pallets for supporting the weight of the users is completed by means of the described support, which leaves a small gap between pallets, as seen in FIG. 6, which prevents having interferences upon making the hinge by means of the pin 4. Furthermore, as seen in the same FIG. 6, the support between the vertical projection 9 and the platform 10 of two consecutive pallets is formed by a convex curved surface 11, the cross-section of which is an arc with a center coinciding with the hinge pin 4 between the pallets. This support with a rounded shape allows rotating the pallets in the overturning and in the transition curves for the inclined walkway.

Figure 7:
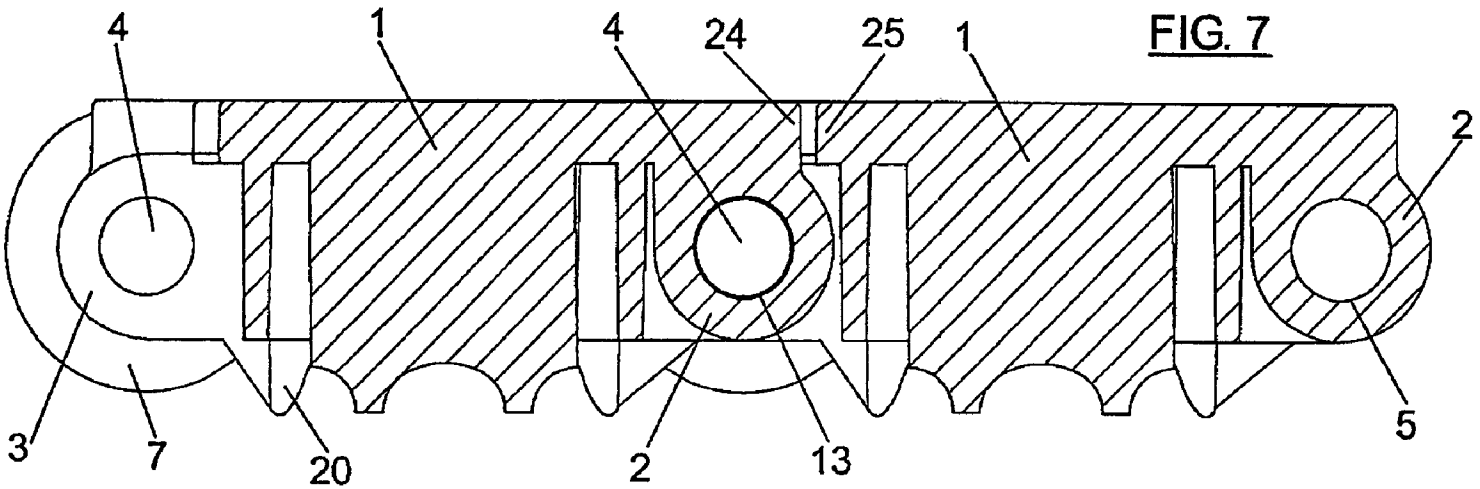
FIG. 7 is a section similar to FIG. 6 taken according to section line VII-VII of FIG. 1.
Figure 9:
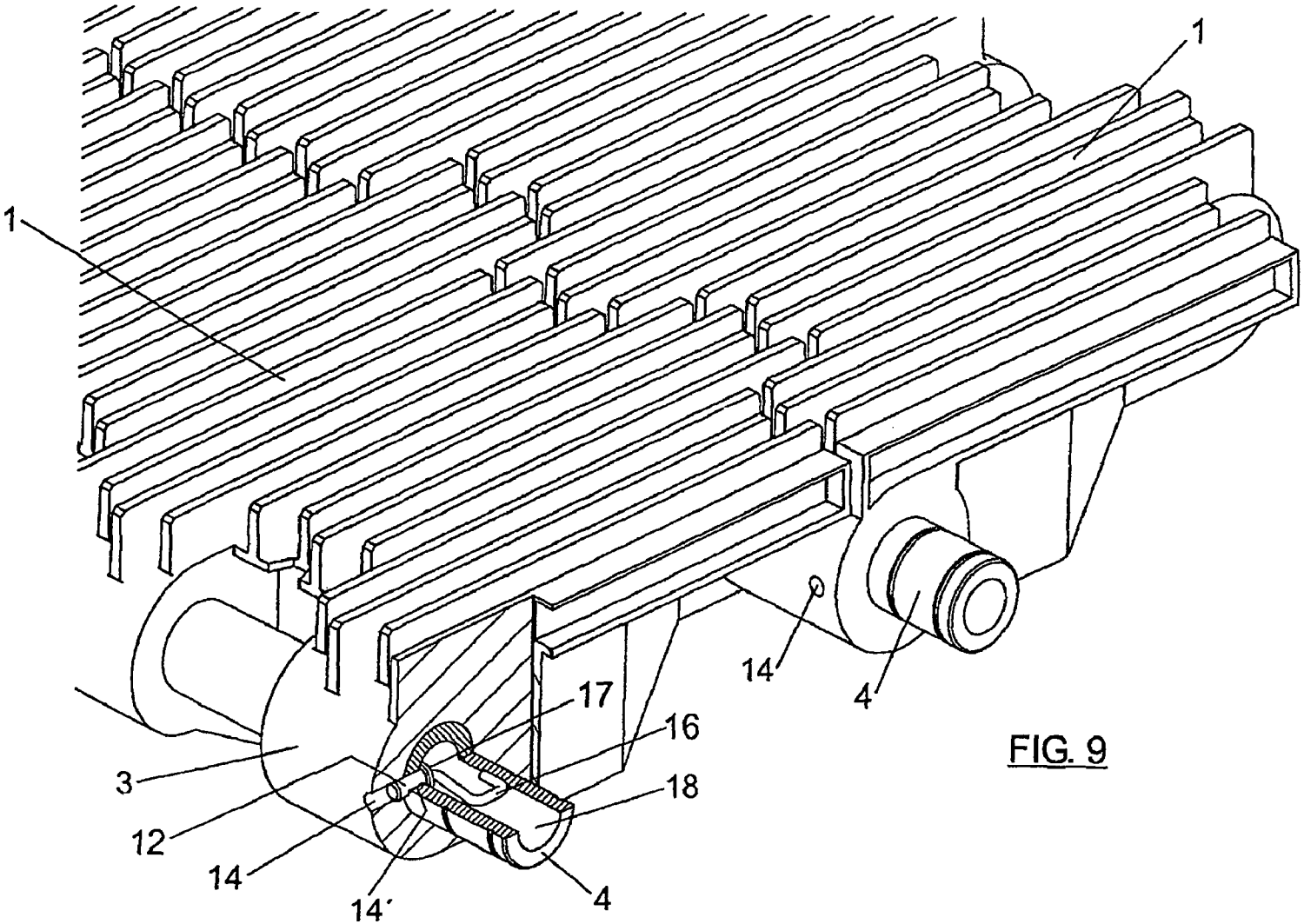
FIG. 9 is a section of the area in which the bolt fixes the pin to the pallet by means of a spring which is placed in a cavity made inside the hinge pin between pallets.

The pin 4 hinging consecutive pallets is fixed to one of the pallets by means of a bolt 12 for example, FIG. 9, whereas it can freely rotate with respect to the other pallet, a condition which can be facilitated by means of the arrangement of a friction bushing 13, FIG. 7, or an openworked bearing on the cavity of the pallet for preventing wear between the pin and tab and allowing the absence of lubrication in the hinge contaminating the useful surface of the pallets.

Figure 8:
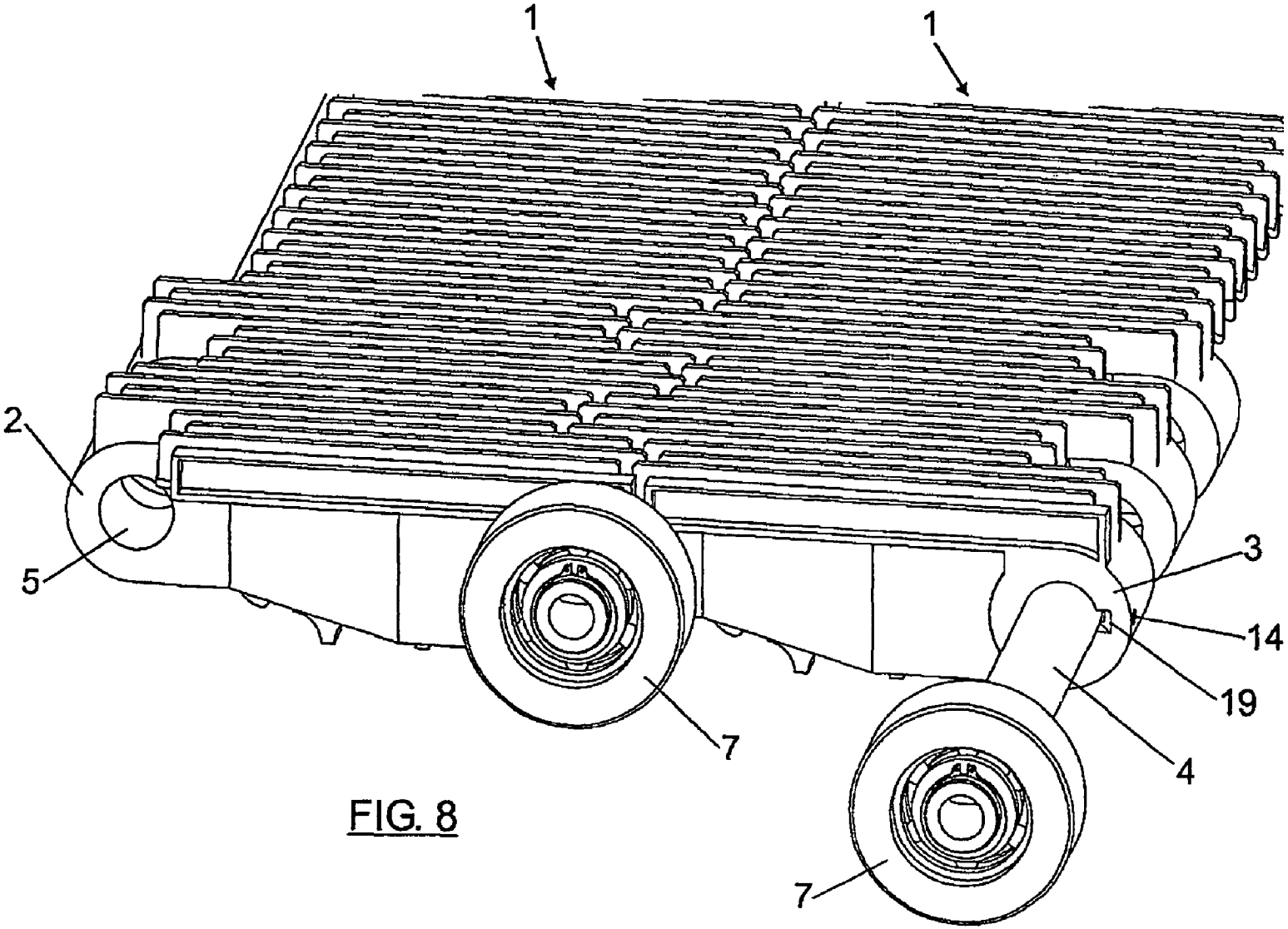
FIG. 8 is an upper partial perspective view of a pallet, showing the hole for accessing the bolt forming the anchoring element of the hinge pin between pallets in the release position between pallets.

As seen in FIGS. 8 and 9, the bolt 12 traverses one of the tabs of the pallets, through a borehole 14, and also the pin 4, through a borehole 14' completely traversing said pin. The bolt 12 can be moved between an outer locking position, shown in FIG. 9, in which it assures the fixing between pin 4 and the tab, preventing the relative rotation and movement between both components, and an inner or release position, in which the bolt is outside the borehole 14, thus allowing the rotation of the pin 4 and the extraction thereof in the available space until the enclosure 15 of the walkway as a result of the reduced length of the pin 4. The bolt could also be moved between an outer release position outside the pin, and an inner locking position in which it traverses the pin and towards which it would be driven by a spring.

In order to facilitate the assembly of the bolt 12 forming the anchoring element, the outermost tab can have a ramp 19 in the orifice 5, FIG. 8, which will facilitate the introduction of said bolt in its housing in the pin.

The bolt 12 is constantly driven toward the locking position of FIG. 9, for example by means of a spring 16 housed in an inner cavity 18 drilled in the pin 4 and assembled between a stop 17 of the actual bolt and the inner wall of the pin, hollowed by means of a borehole.

Engagement means 20 on which the traction of the walkway is carried out are located on the lower or inner surface of the pallets 1, FIGS. 2 and 3.

The pallet has a rib or partition 22 also on the lower surface, on the opposite surface on which the grooves 23 defining the passable surface are located.

As seen in FIG. 7, the end 24 of the grooves ends near the vertical of the hinge as much as possible so that the beginning 25 of the next pallet covers the generated gap, fulfilling the conditions of the standard. The lifting of the end 24 when the pallet overturns is thus prevented, facilitating the reduction of the level difference of the combs limiting the walkway with respect to the line of pallets.

Figure 10:
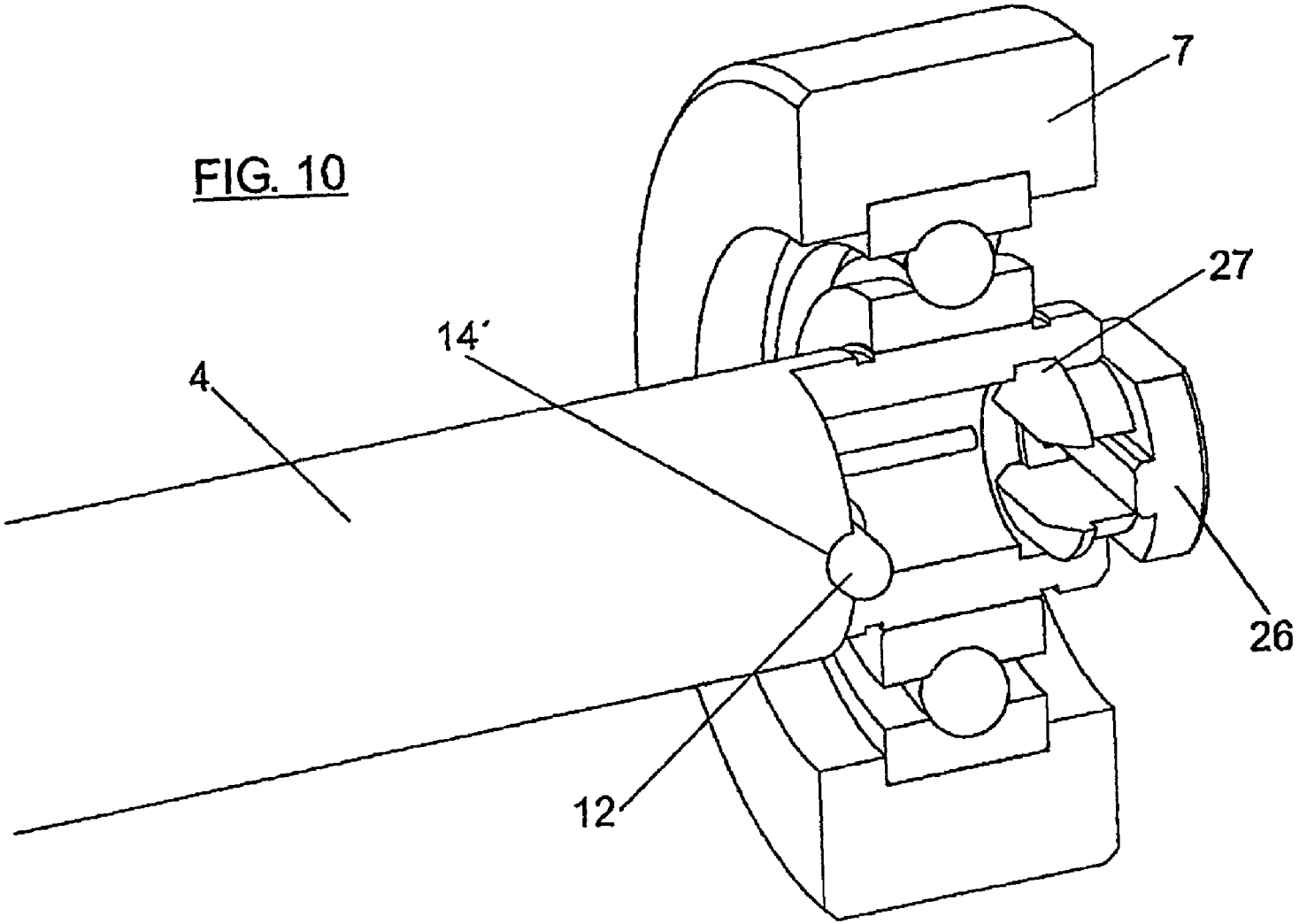
FIG. 10 shows a clipped part in the inner cavity of the hinge pin which will be used for working transversally against a lateral guiding system.

A part 26 made of a material with low friction can be placed by means of a clipping such as that of FIG. 10, which part carries out the tasks of transversely guiding the pallets for their accurate entrance in combs. This clipping can be carried out in an internally turned channel 27 or to the inner holes determined by a through borehole, not shown.

The invention claimed is:

1. A moving walkway formed by a series of pallets with a rectangular contour having a passable surface and connected with drive means, wherein the pallets are consecutively connected to one another along end sections of their adjacent parallel edges, by connection means defining hinges with a pin perpendicular to the direction of movement of the pallets, and have between said end sections means defining, in the forward movement path of the walkway, mutual supports between coplanar consecutive pallets;

the connection means between consecutive pallets comprising groups of vertical tabs projecting from sections of the edges of the pallets perpendicular to the direction of movement, below the passable surface, in alternating positions on both edges; the tabs of which are alternately placed against one another in opposing groups of consecutive pallets and have an orifice which is aligned in all the tabs placed against one another for receiving the pins which are perpendicular to the direction of movement;

each pin being fixed to one of the two pallets that it connects, by means of an anchoring element, and can freely rotate with respect to the other pallet;

the anchoring element comprising a bolt traversing the pin and one of the tabs of the pallet to which said pin is fixed, the bolt being axially moveable between an inner release position, and an extracted retention position, in which the bolt traverses the pin and the tab, said bolt being constantly driven toward locking position by means of a spring housed in an inner cavity drilled in the pin; and wherein a channel on which a part is assembled by means of clipping is included in the inner cavity of the hinge pin, on which part the lateral guiding of the band of pallets is carried out.

2. A walkway according to claim 1, wherein the pallets have in each edge perpendicular to the direction of movement two end groups of tabs, one on each side, occupying sections with a length less than half the length of said edges, some of the tabs of the groups of one edge being introducible between the tabs of the opposing groups of consecutive pallets by way of tonguing and grooving until the orifices thereof are aligned.

3. A walkway according to claim 1, wherein the means defining the mentioned supports consists of a longitudinal projection vertically projecting from the lower surface of each pallet, in a position adjacent to one of the edges perpendicular to the direction of movement, and in a horizontal longitudinal platform projecting from the opposite edge, at a height coinciding with the end of the mentioned projection; the projection and platform of which run between the end groups of tabs and are vertically opposed and supported between one another on coplanar consecutive pallets along the forward movement path.

4. A walkway according to claim 3, wherein the support between the vertical projection and platform of the two consecutive pallets is formed by a convex curved surface, the cross-section of which is an arc with a center coinciding with the hinge pin between pallets.

5. A walkway according to claim 1, wherein each hinge pin has assembled thereon a roller which is located after the outermost tab and is supported and rolls on fixed lateral guides.

6. A walkway according to claim 1, wherein the bolt is axially moveable between an inner locking position, in which it traverses the mentioned pin and tab, and an extracted release position, in which it does not traverse the pin, said bolt being constantly driven toward the locking position by means of a spring.

7. A walkway according to claim 1, wherein the tab with which the anchoring element is connected has, from the orifice, a ramp for retracting the bolt to the retention position.

8. A walkway according to claim 1, wherein each pallet has, on the surface opposite the passable surface, reinforcing ribs.

9. A walkway according to claim 1, wherein each pallet has, on the surface opposite the passable surface, engagement means for engaging with the drive means.

10. A walkway according to claim 1, wherein the rotation between pallets is caused by friction with a bushing without lubrication fixed to the cavity of the pallet under pressure.

11. A walkway according to claim 1, wherein the rotation between the pallet and the hinge pin occurs by means of an openworked bearing on the cavity of the pallet.

12. A walkway according to claim 1, wherein a through borehole is included on the pin and that the part for lateral guiding is assembled by means of clipping on the inner outlets of the through hole.

13. A walkway according to claim 1, wherein on the passable surface there are included grooves in the direction of movement of the walkway which end as close as possible to the vertical of the hinge in order to prevent the end of the groove from lifting during the overturning.

* * * * *